US010329818B2

(12) United States Patent
Lin et al.

(10) Patent No.: US 10,329,818 B2
(45) Date of Patent: Jun. 25, 2019

(54) HINGE ASSEMBLY

(71) Applicant: Fujian Xihe Sanitary Ware Technology Co., Ltd., Nan'An (CN)

(72) Inventors: Xiaofa Lin, Nan'An (CN); Xiaoshan Lin, Nan'An (CN); Qiqiao Liu, Nan'An (CN); Xiaoqing Deng, Nan'An (CN); Pengxing Zheng, Nan'An (CN)

(73) Assignee: Fujian Zihe Sanitary Ware Technology Co., Ltd., Fujian (CN)

( * ) Notice: Subject to any disclaimer, the term of this patent is extended or adjusted under 35 U.S.C. 154(b) by 0 days.

(21) Appl. No.: 15/857,994

(22) Filed: Dec. 29, 2017

(65) Prior Publication Data

US 2019/0063129 A1 Feb. 28, 2019

(30) Foreign Application Priority Data

Aug. 30, 2017 (CN) ..... 2017 1 0763291
Aug. 30, 2017 (CN) ..... 2017 2 1101747 U

(51) Int. Cl.

| | |
|---|---|
| ***E05F 1/06*** | (2006.01) |
| ***E05D 7/10*** | (2006.01) |
| *E05D 3/02* | (2006.01) |
| *E05D 11/00* | (2006.01) |
| *E05D 5/04* | (2006.01) |

(52) U.S. Cl.

CPC ..... *E05F 1/063* (2013.01); *E05D 7/10* (2013.01); *E05D 7/1044* (2013.01); *E05F 1/06* (2013.01); *E05D 3/02* (2013.01); *E05D 5/04* (2013.01); *E05D 11/00* (2013.01); *E05Y 2900/114* (2013.01); *E05Y 2900/132* (2013.01)

(58) Field of Classification Search

CPC .... E05F 1/06; E05F 1/063; E05D 7/10; E05D 7/1044

USPC ..... 16/271, 252, 362, 309, 312, 313, 314, 16/315, 318

See application file for complete search history.

(56) References Cited

U.S. PATENT DOCUMENTS

| | | | | |
|---|---|---|---|---|
| 749,379 A * | 1/1904 | Hartman | ..... | E05F 1/063 16/318 |
| 3,733,650 A * | 5/1973 | Douglas | ..... | E05F 1/063 16/312 |
| 4,631,777 A * | 12/1986 | Takimoto | ..... | E05F 1/063 16/312 |
| 6,704,966 B1 * | 3/2004 | Kao | ..... | E05D 5/0246 16/252 |

(Continued)

*Primary Examiner* — Jeffrey O'Brien

(74) *Attorney, Agent, or Firm* — The Dobrusin Law Firm, PC

(57) ABSTRACT

The present disclosure provides a hinge assembly including a first hinge body, a second hinge body, a movable block, a pushing block, a cushion block, and a pivot. The pivot is fixedly mounted to the first hinge body and is provided with a planar recess on a shaft body surface thereof. The movable block and the second hinge body are detachably connected to each other. The movable block is pivotally connected with the first hinge body via the pivot. A top surface of the movable block abuts against the first hinge body. The pushing block includes a first inclined surface. The cushion block includes a second inclined surface. A top surface of the pushing block abuts against the movable block. The pushing block slidably abuts against the shaft body of the pivot. The hinge assembly according to the present disclosure realizes seamless lifting of the hinge.

11 Claims, 5 Drawing Sheets

(56) References Cited

U.S. PATENT DOCUMENTS

| | | | | |
|---|---|---|---|---|
| 6,766,561 | B1 * | 7/2004 | Cheng | E05D 5/0246 16/235 |
| 7,000,289 | B2 * | 2/2006 | Cedrone | E05F 1/063 16/273 |
| 7,861,374 | B2 * | 1/2011 | Verdicchio | E05D 1/02 16/225 |
| 7,917,994 | B2 * | 4/2011 | Bai | E05D 11/105 16/252 |
| 8,381,357 | B2 * | 2/2013 | Zinn | E05D 7/02 16/250 |
| 8,621,715 | B2 * | 1/2014 | Mitchell | E05D 5/04 16/312 |
| 9,435,103 | B2 * | 9/2016 | Lee | E05F 1/063 |
| 2008/0083086 | A1 * | 4/2008 | Lin | E05D 5/0246 16/252 |
| 2008/0083087 | A1 * | 4/2008 | Lin | E05D 11/1064 16/252 |
| 2008/0168621 | A1 * | 7/2008 | Lin | E05D 11/1064 16/252 |

* cited by examiner

HINGE ASSEMBLY

CROSS-REFERENCE TO RELATED APPLICATION

The present application is based upon and claims the benefit of priorities of Chinese Patent Application Nos. 201710763291.3 and 201721101747.1, filed on Aug. 30, 2017, the entire contents of which are incorporated herein by reference.

TECHNICAL FIELD

The present disclosure relates to a hinge assembly, in particular, a hinge assembly for a shower door.

BACKGROUND

In the field of house construction, generally, the hinge assembly used particularly for a shower door is a common side-hung hinge assembly, i.e., the shower door is opened and closed by rotation in the same level. In order to prevent water in the show room from flowing outside from the gap between the shower door and the floor, usually, a waterproof rubber tape is mounted along a bottom edge of the shower door. Thus, if the shower door is rotated in the same level to be opened, the waterproof rubber tape will have a friction against the ground during the rotation, which will not only produce resistance during the opening of the shower door, but also damage the waterproof rubber tape and causes problems such as waterproofing failure and scratch of the ground. Some of the current shower doors also use a rotary lifting hinge assembly. However, the structure of such rotary lifting hinge assembly is complicated and inconvenient for assemble and dissemble; the rotation angle is greatly affected by the lifting structure; and the rotary lifting hinge assembly has poor performance in universality and cannot be adapted for various types of shower doors.

Chinese patent application No. 201710221479.5 provides a lifting hinge assembly, comprising an upper sleeve, a lower sleeve, a connection rod, a first hinge sheet and a second hinge sheet; the upper sleeve being provided with a closed cylinder body having an inner gear provided on an inner cylinder wall; the lower sleeve including a step hole, in which a large hole and a small hole are provided offset; the connecting rod including a top abutting portion, a gear portion and a guide pillar that are fixedly connected from top to bottom to form an integral body; the guide pillar of the connection rod being screwed to be connected in the small hole of the step hole of the lower sleeve; wherein the first hinge sheet is driven to drive the upper sleeve thereon to rotate; the gear portion on the connection rod rotates to drive the connection rod to perform an up-and-down screw rotation in the small hole of the lower sleeve; the top abutting portion of the connection rod abuts a cylinder bottom of the upper sleeve such that the upper sleeve and the first hinge sheet in fixed connection with the upper sleeve lift up or lower down in an axial direction. Such a lifting hinge assembly has various shortcomings. For example, when the upper sleeve brings the first hinge sheet to lift up, the upper sleeve and the lower sleeve gradually separate and can form an interval therebetween. The interval tends to contain dirt and dust and can be difficult to clean. One may be injured when cleaning the interval. Moreover, the hinge assembly may sacrifice the appearance.

SUMMARY

In one aspect, in general, the present disclosure describes a hinge assembly that alleviates the defects mentioned above.

In another aspect, in general, the present disclosure describes a hinge structure comprising a first hinge body, a second hinge body, a pivot, a movable block, a pushing block, and a cushion block. The pivot is fixedly mounted to a side of the first hinge body and provided with a planar recess on a shaft body surface thereof. The movable block is detachably connected with the second hinge body and pivotally connected with the first hinge body via the pivot, wherein a top surface of the movable block is configured to abut the first hinge body. The pushing block comprises a first inclined surface and is configured to slidably abut the shaft body of the pivot, wherein a top surface of the pushing block is configured to abut the movable block. The cushion block is arranged on the second hinge body and comprises a second inclined surface. Wherein, the pushing block is configured to, in a case where the first hinge body brings the pivot to rotate from a first position to a second position, switch from a first status to a second status, slide upward along the second inclined surface of the cushion block, and bring the movable block and the first hinge body to move upward. The first status is a status where the pushing block is configured to abut the planar recess of the pivot, and the second status is a status where the pushing block is configured to abut a rotary surface of the pivot on either side of the planar recess. The pushing block is further configured to, in a case where the first hinge body brings the pivot to rotate from the second position to the first position, switch from the second status to the first status, slide downward along the second inclined surface, and bring the first hinge body to lower down.

BRIEF DESCRIPTION OF THE DRAWINGS

The present disclosure will be further explained with reference to the attached drawings and embodiments.

EMBODIMENTS

Figure 1:
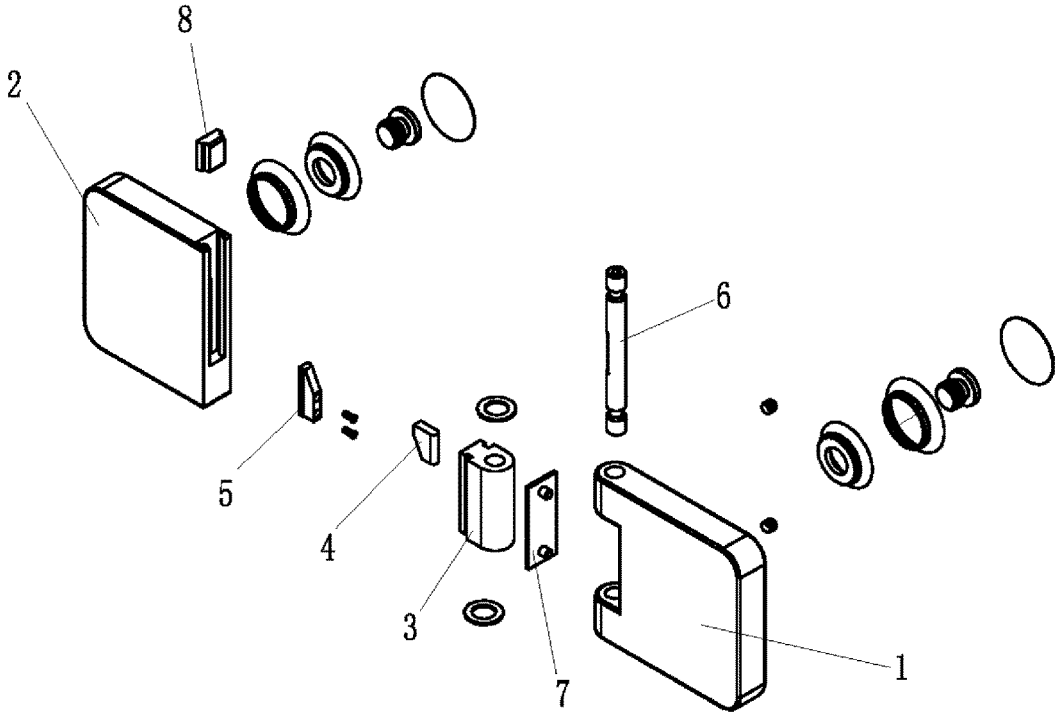
FIG. 1 is an exploded perspective view of the hinge assembly.
Figure 2:
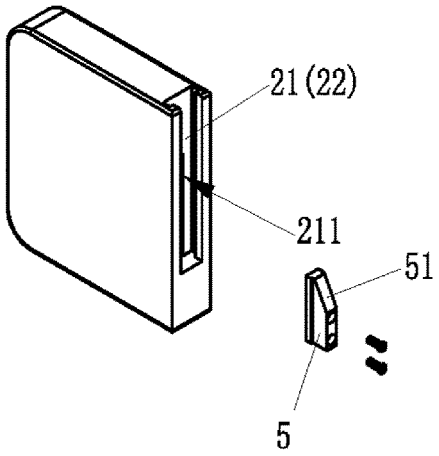
FIG. 2 is an exploded assembly view of the second hinge body and the cushion block.
Figure 3:
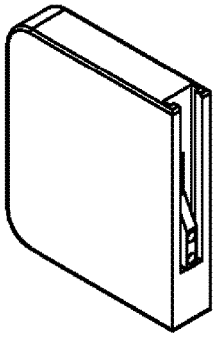
FIG. 3 is a completed assembly view of the second hinge body and the cushion block.
Figure 4:
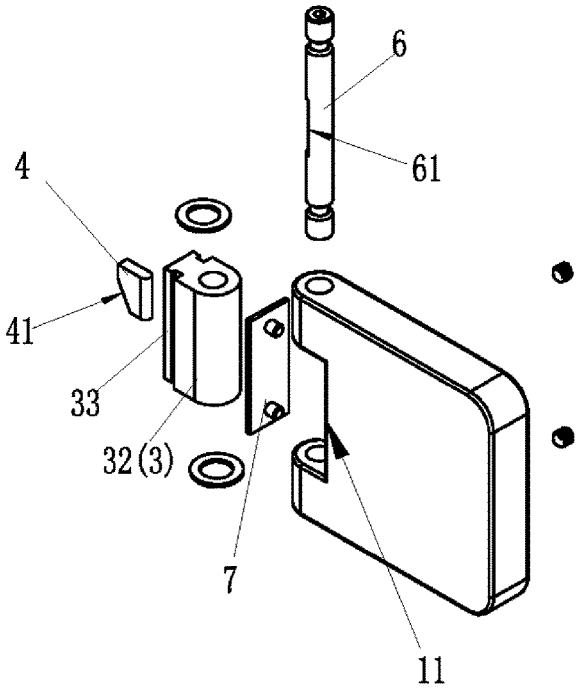
FIG. 4 is an exploded assembly view of the first hinge body, the pushing block, the movable block and the pivot.
Figure 5:
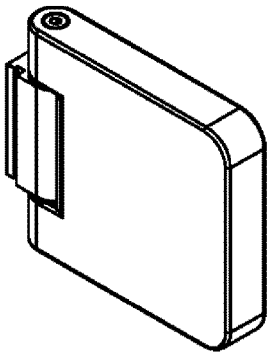
FIG. 5 is a completed assembly view of the first hinge body, the pushing block, the movable block and the pivot.
Figure 6:
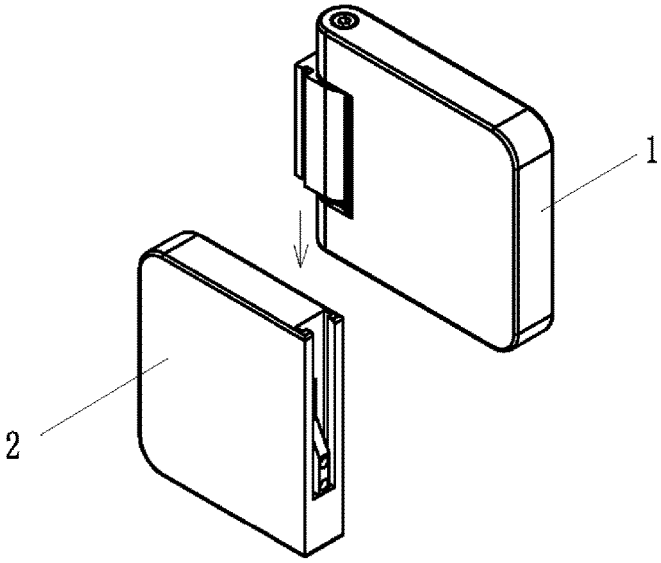
FIG. 6 is an assembly diagram of FIG. 3 and FIG. 5.
Figure 7:
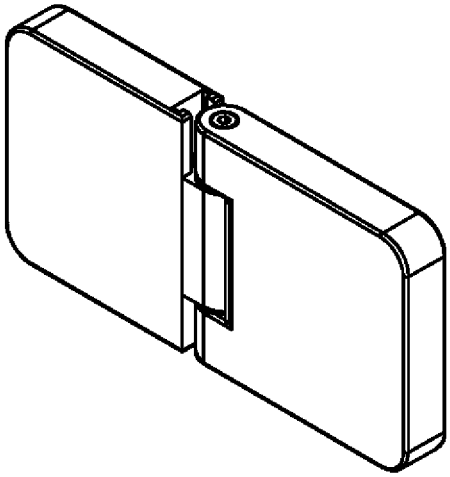
FIG. 7 is a completed assembly view of FIG. 3 and FIG. 5.
Figure 8:
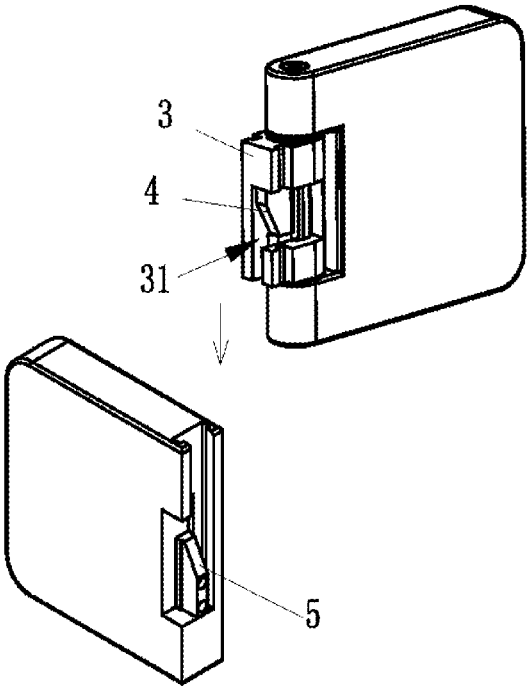
FIG. 8 is a partially cut-out view of FIG. 6.
Figure 9:
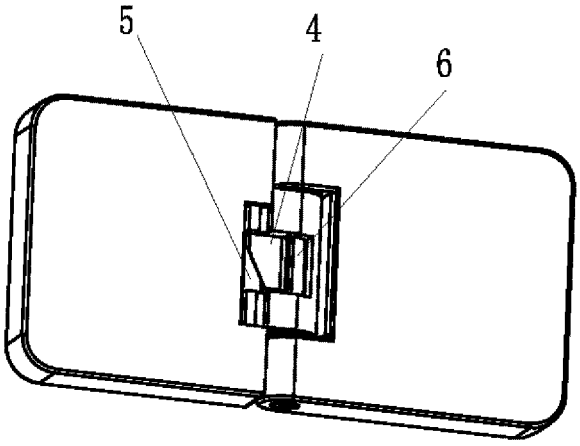
FIG. 9 is a partially cut-out view of FIG. 7.
Figure 10:
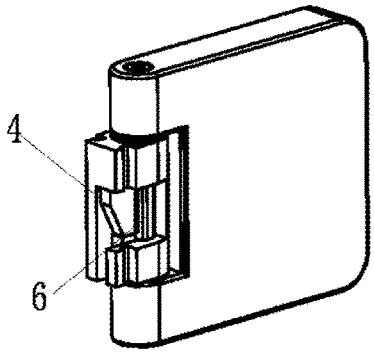
FIG. 10 is a diagram of the first hinge body in a reset state.
Figure 11:
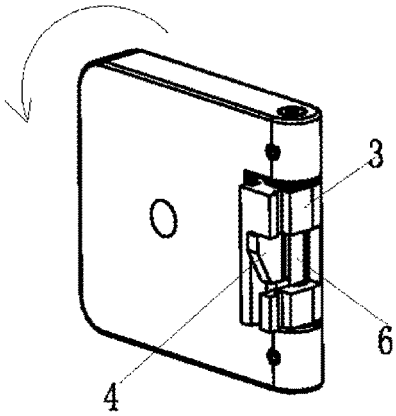
FIG. 11 is a diagram of the first hinge body after a counterclockwise rotation.
Figure 12:
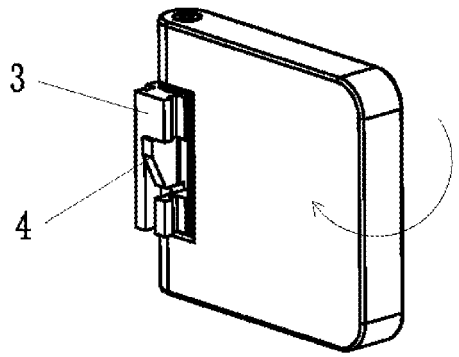
FIG. 12 is a diagram of the first hinge body after a clockwise rotation.

Referring to FIGS. 1-12, there is provided a hinge assembly, comprising a first hinge body 1, a second hinge body 2, a movable block 3, a pushing block 4, a cushion block 5 and a pivot 6.

The pivot 6 is fixedly mounted on the first hinge body 1 and is provided in a shaft body surface thereof a planar recess 61, a bottom surface of the planar recess 61 being a plane, and two sides of the planar recess 61 being rotary surfaces of the pivot 6.

The movable block 3 is detachably connected to the second hinge body 2 and is pivotally connected to the first hinge body 1, a top surface of the movable block 3 abutting against the first hinge body 1, a first housing groove 31 being provided in the movable block 3, which communicates with and is corresponding to the planar recess 61 in the pivot 6; a second housing groove 21 being provided in the second hinge body 2, the first housing groove 31 and the second housing groove 21 facing to and communicating with each other to form a working cavity for cooperative activity of the cushion block 5 and the pushing block 4.

The pushing block 4 has a first inclined surface 41, the cushion block has a second inclined surface 51, the pushing block 4 and the cushion block 5 are arranged up and down in the working cavity with the first inclined surface 41 and the second inclined surface 51 fitting to each other, the cushion block 5 being fixed in the second housing groove 21, a top surface of the pushing block 4 abutting against the movable block 3, the pushing block 4 slidably abutting the shaft body of the pivot 6.

The first hinge body 1 brings the pivot 6 to rotate backward and forward such that the pushing block 4 slides in a reciprocating manner between a planar surface in the planar recess 61 of the pivot 6 and a rotary surface on both sides of the planar recess 61, thereby causing that the pushing block 4 slides downward along the second inclined surface 51 of the cushion block 5 and allows the first hinge body 1 to lower down to reset, or that the pushing block 4 slides upward along the second inclined surface 51 of the cushion block 5 and abuts against the movable block 3 to drive the first hinge body 1 to perform an upward motion. A lifting rotation of the hinge is realized, with a large angle for the lifting rotation and a credible lifting effect. Moreover, the rotation of the pivot is transformed to relative sliding between the first inclined surface of the pushing block and the second inclined surface of the cushion block, which is a mechanical transmission with smooth and steady nature and small friction, realizing easy lifting with a small force, and thereby making the use of the shower room easy for the elder and children.

The movable block 3 comprises a sleeve 32 for pivotally jointing with the pivot 6 and a first snap engagement portion 33 formed integrally with the sleeve 32; and a second snap engagement portion 22 is provided on a side of the second hinge body 2 for snap engagement with the first snap engagement portion 33. In this embodiment, the first snap engagement portion 33 is vertical ribs of a double-boss structure provided parallel with an axial direction of the sleeve 32; and the second snap engagement portion 22 is a vertical slot adaptive for engaging with the vertical ribs; the first housing groove is a through groove passing between the vertical ribs of the movable block 3 and through a sleeve wall of the sleeve 32; the planar recess 61 in the pivot 6 is just corresponding to the position of a groove opening of the through groove; the pushing block 4 is arranged in the through groove, with a back surface thereof abutting against the planar surface of the planar recess 61 in the pivot 6, a top surface thereof abutting against a top surface of the through groove, and the left and right side surfaces fittingly contacting with the groove walls of the through groove; and the second housing groove 21 is a part of the vertical slot. When the first hinge body ascends, there is no gap between the first hinge body and the second hinge body, obtaining a good appearance and avoiding accumulation of dirt and dust, and thus easy for cleaning and eliminating the possibility of injury.

As an option, a positioning slot 211 is provided depressing in the vertical slot, and the cushion block 5 is fixed in the positioning slot 211; the positioning slot 211 provides a positioning guide for mounting the cushion block 5 and a space for moving of the pushing block 4 in a sliding direction with regard to the cushion block 5.

Preferably, the contacting surface where the pushing block 4 slidably abuts the shaft body of the pivot 6 is a rounded surface, which reduces a rotational friction between the pushing block 4 and the pivot 6, preventing early wear of the pushing block and increasing the life span of the pushing block.

The first hinge body 1 is provided on a side a mounting groove 11 for mounting the movable block 3, the movable block 3 abutting against a bottom surface of the mounting groove 11, and the abutting surface of the movable block 3 being a rounded surface, which reduces a rotational friction between the movable block 3 and the first hinge body 1. Preferably, a crash pad 7 is provided between the movable block 3 and the bottom surface of the mounting groove 11 to reduce the rotation noise between the movable block 3 and the first hinge body 1.

After the movable block 3 is snap-engaged with the second hinge body 2, there is a vacant space remained and exposed in the top part of the vertical slot of the second hinge body 2. In order to prevent dirt from accumulating in the vacant space and to ensure the overall appearance of the assembly, a blocking piece 8 is provided on the top part of the vertical slot.

Referring to FIGS. 2-9, the installation of the hinge assembly includes the following steps:

(1) mounting the crash pad 7 to the bottom surface of the mounting groove 11 of the first hinge body 1, linking the first hinge body 1 and the movable block 3 with the pivot 6, and mounting the pushing block 4 in the first housing groove 31 of the movable block 3;

(2) fixing the cushion block 5 in the positioning slot 211 of the first hinge body 1;

(3) snapping the first snap engagement portion 33 of the movable block 3 into the second housing groove 21 of the second hinge body 2, the pushing block 4 and the cushion block 5 being arranged up and down, and the first inclined surface 41 fitting the second inclined surface 51, the first hinge body 1 and the second hinge body 2 connected to form a whole hinge;

(4) locking the first hinge body 1 and the second hinge body 2 to the room door with a screw.

Figure 13:
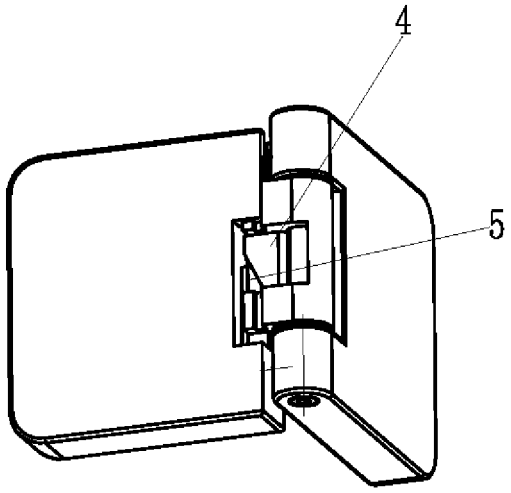
FIG. 13 is a diagram of the hinge assembly in a lifting up state after the rotation of the first hinge body.

Referring to FIGS. 10-13, the working process of the hinge assembly is as follows.

When the first hinge body 1 is in a reset state (at this time, the door is closed), the rounded surface of the pushing block 4 is in contact with the planar surface of the pivot 6, and the pushing block 4 is at a reset position.

When the first hinge body 1 rotates counterclockwise or clockwise (at this time, the door is opening), the rounded surface of the pushing block 4 changes from contacting the planar surface of the pivot 6 to contacting the rotary surface of the pivot 6, during which, the pushing block 4 is driven by the pivot 6 to move outward (that is, move toward the second hinge body 2).

When the pushing block 4 moves outward, it moves with regard to the second inclined surface 51 of the cushion block 5 in a frictional and offset manner; because the cushion block 5 stays still, the pushing block 4 moves upward under cooperation of the first inclined surface 41 and the second inclined surface 51; when moving upward, the pushing block 41 pushes the movable block 3 to drive the first hinge body 1 to move upward.

On the contrary, when the first hinge body 1 returns to the reset state, the rounded surface of the pushing block 4 contacts the planar surface of the pivot 6, the pushing block 4 resets, and the first hinge body 1 lowers down.

The lifting hinge assembly according to the present disclosure is highly universal and fulfills the requirement of various room types. Also, the lifting hinge assembly according to the present disclosure is easy for mounting, maintenance and cleaning; with a low cost and a simple structure, it is favorable for mass production.

The foregoing has described what are considered to be the preferable examples of the present disclosure. Therefore, it is understood that the implementation of the present disclosure is not limited to the foregoing description. Equivalent modifications and variations made according to the scope of the claims and the description of the present disclosure shall be considered as being covered in the scope of the present disclosure.

The invention claimed is:

1. A hinge assembly, comprising:

a first hinge body;

a second hinge body;

a pivot fixedly mounted to a side of the first hinge body and provided with a planar recess on a shaft body surface thereof;

a movable block detachably connected with the second hinge body and pivotally connected with the first hinge body via the pivot, wherein a top surface of the movable block is configured to abut the first hinge body;

a pushing block comprising a first inclined surface and configured to slidably abut the shaft body of the pivot, wherein a top surface of the pushing block is configured to abut the movable block; and a cushion block arranged on the second hinge body and comprising a second inclined surface, wherein, the pushing block is configured to in a case where the first hinge body brings the pivot to rotate from a first position to a second position, switch from a first status to a second status, slide upward along the second inclined surface of the cushion block, and bring the movable block and the first hinge body to move upward with respect to the second hinge body, the first status being a status where the pushing block is configured to abut the planar recess of the pivot, the second status being a status where the pushing block is configured to abut a rotary surface of the pivot on either side of the planar recess, and in a case where the first hinge body brings the pivot to rotate from the second position to the first position, switch from the second status to the first status, slide downward along the second inclined surface, and bring the movable block and the first hinge body to move downward with respect to the second hinge body.

2. The hinge assembly according to claim 1, wherein the movable block comprises a sleeve for pivotally connecting with the pivot and a first snap engagement portion formed integrally with the sleeve, and a second snap engagement portion is provided on a side of the second hinge body for snap engagement with the first snap engagement portion.

3. The hinge assembly according to claim 2, wherein the first snap engagement portion is vertical ribs of a double-boss structure provided parallel with an axial direction of the sleeve, and the second snap engagement portion is a vertical slot adaptive for engagement with the vertical ribs.

4. The hinge assembly according to claim 3, wherein a first housing groove is provided in the movable block and is configured to communicate with the planar recess of the pivot, a second housing groove is provided in the second hinge body, and the first and second housing grooves are provided opposite to each other and configured as a working cavity for cooperation of the cushion bock and the pushing block.

5. The hinge assembly according to claim 4, wherein the pushing block and the cushion block are arranged vertically in the working cavity, the first inclined surface and the second inclined surface are configured to fit to each other, and the cushion block is fixed in the second housing groove.

6. The hinge assembly according to claim 4, wherein the first housing groove is a through groove passing between the vertical ribs of the movable block and through a sleeve wall of the sleeve, the pushing block is arranged in the through groove with the top surface thereof abutting against a top surface of the through groove, and the second housing groove is a part of the vertical slot.

7. The hinge assembly according to claim 6, wherein a positioning slot is provided depressing in a bottom surface of the vertical slot, and the cushion block is fixed in the positioning slot.

8. The hinge assembly according to claim 1, wherein a contacting surface of the pushing block slidably abutting the shaft body of the pivot is a rounded surface.

9. The hinge assembly according to claim 1, wherein a mounting groove for mounting the movable block is provided on a side of the first hinge body, the movable block is configured to abut against a bottom surface of the mounting groove, and an abutting surface of the movable block is a rounded surface.

10. The hinge assembly according to claim 9, wherein a crash pad is provided between the movable block and the bottom surface of the mounting groove.

11. The hinge assembly according to claim 3, wherein a blocking piece is provided at a top of the vertical slot.

* * * * *